US010563441B2

(12) United States Patent
Kellum, III

(10) Patent No.: US 10,563,441 B2
(45) Date of Patent: Feb. 18, 2020

(54) CONSTANT FORCE WINDOW BALANCE ENGAGEMENT SYSTEM

(71) Applicant: Amesbury Group, Inc., Amesbury, MA (US)

(72) Inventor: Wilbur James Kellum, III, Garretson, SD (US)

(73) Assignee: AMESBURY GROUP, INC., Amesbury, MA (US)

( * ) Notice: Subject to any disclaimer, the term of this patent is extended or adjusted under 35 U.S.C. 154(b) by 373 days.

(21) Appl. No.: 15/355,746

(22) Filed: Nov. 18, 2016

(65) Prior Publication Data

US 2017/0145722 A1 May 25, 2017

Related U.S. Application Data

(60) Provisional application No. 62/258,216, filed on Nov. 20, 2015.

(51) Int. Cl.
*E05D 13/00* (2006.01)

(52) U.S. Cl.
CPC ..... *E05D 13/1292* (2013.01); *E05D 13/1276* (2013.01); *E05Y 2900/148* (2013.01); *Y10T 16/64* (2015.01)

(58) Field of Classification Search
CPC . E05D 13/1292; E05D 13/1276; E05D 13/06; Y10T 16/197; Y10T 16/201; Y10T 16/195; Y10T 16/193; E05Y 2900/148; E05F 11/42
USPC ..... 16/197, 201, 195, 193; 49/362
See application file for complete search history.

(56) References Cited

U.S. PATENT DOCUMENTS

| | | | | |
|---|---|---|---|---|
| 698,168 A | | 4/1902 | Barnum | |
| 887,968 A | | 5/1908 | Selkirk | |
| 1,007,212 A | | 10/1911 | Lasersohn | |
| 1,312,665 A | | 8/1919 | Almquist | |
| 1,420,503 A | * | 6/1922 | Throne | E05F 11/42 16/201 |

(Continued)

FOREIGN PATENT DOCUMENTS

| | | |
|---|---|---|
| CA | 1155341 | 10/1983 |
| CA | 2119506 | 10/1994 |

(Continued)

OTHER PUBLICATIONS

PCT International Search Report and Written Opinion in International Application PCT/US2018/026500, dated Jun. 22, 2018, 13 pages.

(Continued)

*Primary Examiner* — William L Miller

(57) ABSTRACT

A window balance system includes a mounting bracket configured to be secured to a window jamb, a shoe body and a coil spring movably coupling the mounting bracket to the shoe body. The window balance system also includes an engagement member extending from at least one of the mounting bracket and the shoe body, wherein the engagement member includes at least one resilient arm having a pawl extending therefrom. The window balance system further includes a receiving member defined in at least the other one of the mounting bracket and the shoe body, wherein the receiving member includes at least one rack having at least one tooth extending therefrom such that the pawl is engageable with the rack.

16 Claims, 9 Drawing Sheets

(56) References Cited

U.S. PATENT DOCUMENTS 1,480,453 A * 1/1924 Lane ..... E05D 13/06 49/119
2,069,025 A * 1/1937 Anderson ..... E05D 13/06 49/98
2,178,533 A 10/1939 Viehweger
2,209,293 A * 7/1940 Cannon ..... E05D 13/06 292/280
2,602,958 A 7/1952 Brown
2,609,191 A 9/1952 Foster
2,609,193 A 9/1952 Foster
2,622,267 A 12/1952 Peremi
2,635,282 A 4/1953 Trammell, Sr. et al.
2,644,193 A 7/1953 Anderberg
2,684,499 A 7/1954 Lewis
2,732,594 A 1/1956 Adams et al.
2,739,344 A 3/1956 Dickinson
2,766,492 A * 10/1956 Day ..... E05F 11/42 16/195
2,807,045 A * 9/1957 Chenoweth ..... E06B 3/44 16/201
2,817,872 A 12/1957 Foster
2,851,721 A 9/1958 Decker et al.
2,873,472 A 2/1959 Foster
2,952,884 A 9/1960 Dinsmore
3,007,194 A 11/1961 Griswold
3,105,576 A 10/1963 Jones et al.
3,150,420 A 9/1964 Brenner
3,184,784 A 5/1965 Peters
3,364,622 A 1/1968 Collard
3,434,236 A 3/1969 Weidner et al.
3,445,964 A 5/1969 Foster
3,452,480 A 7/1969 Foster
3,461,608 A 8/1969 Johnson
3,475,865 A 11/1969 Arnes
3,497,999 A 3/1970 Hendra
3,529,381 A 9/1970 Grossman
3,676,956 A 7/1972 Taylor et al.
3,732,594 A 5/1973 Mills
3,820,193 A 6/1974 Foster
3,844,066 A 10/1974 Nobes
3,869,754 A 3/1975 Foster
3,992,751 A 11/1976 Foster et al.
4,028,849 A 6/1977 Anderson
4,068,406 A 1/1978 Wood
4,079,549 A 3/1978 Wood
4,089,085 A 5/1978 Fitzgibbon
4,190,930 A 3/1980 Prosser
4,227,345 A 10/1980 Durham, Jr.
4,228,620 A * 10/1980 Hutchins ..... B24B 23/043 384/42
4,300,316 A 11/1981 Ficurilli
4,332,054 A 6/1982 Paist et al.
4,364,199 A 12/1982 Johnson et al.
4,446,654 A 5/1984 Schoolman et al.
4,452,012 A 6/1984 Deal
4,506,478 A 3/1985 Anderson
4,510,713 A 4/1985 Anderson
4,517,766 A 5/1985 Haltof
4,555,868 A 12/1985 Mancuso
4,570,382 A 2/1986 Suess
4,571,887 A 2/1986 Haltof
4,590,708 A 5/1986 Campodonico
4,610,108 A 9/1986 Marshik
4,642,845 A 2/1987 Marshik
4,683,676 A 8/1987 Sterner, Jr.
4,689,850 A 9/1987 Flight
4,697,304 A 10/1987 Overgard
4,704,821 A 11/1987 Berndt
4,718,194 A 1/1988 FitzGibbon et al.
4,785,581 A 11/1988 Abramson et al.
4,799,333 A 1/1989 Westfall et al.
4,837,976 A 6/1989 Westfall et al.
4,854,077 A 8/1989 Rogers et al.
4,885,871 A 12/1989 Westfall et al.
4,888,915 A 12/1989 Goldenberg
4,914,861 A 4/1990 May
4,922,657 A 5/1990 Foss
4,930,254 A 6/1990 Valentin
4,935,987 A 6/1990 Sterner, Jr.
4,941,285 A 7/1990 Westfall
4,949,425 A 8/1990 Dodson et al.
4,953,258 A 9/1990 Mennuto
4,958,462 A 9/1990 Cross
4,961,247 A 10/1990 Leitzel et al.
5,035,081 A 7/1991 Yamamoto et al.
5,036,621 A 8/1991 Iwasaki
5,069,001 A 12/1991 Makarowski
5,113,922 A 5/1992 Christensen et al.
5,119,591 A 6/1992 Sterner, Jr. et al.
5,119,592 A 6/1992 Westfall et al.
5,127,192 A 7/1992 Cross
5,140,769 A 8/1992 Hickson et al.
5,157,808 A 10/1992 Sterner, Jr.
5,189,838 A 3/1993 Westfall
5,210,976 A 5/1993 Cripps
5,232,208 A 8/1993 Braid et al.
5,251,401 A 10/1993 Prete et al.
5,301,467 A 4/1994 Schmidt et al.
5,353,548 A * 10/1994 Westfall ..... E05D 13/1276 16/197
5,365,638 A 11/1994 Braid et al.
5,371,971 A 12/1994 Prete
5,377,384 A 1/1995 Riegelman
5,383,303 A 1/1995 Nakanishi et al.
D355,262 S 2/1995 Chaney et al.
5,440,837 A * 8/1995 Piltingsrud ..... E05D 15/22 49/139
5,445,364 A 8/1995 Tibbals, Jr.
5,448,858 A 9/1995 Briggs et al.
5,452,495 A 9/1995 Briggs
5,463,793 A 11/1995 Westfall
5,463,795 A 11/1995 Carlson et al.
5,530,991 A 7/1996 deNormand et al.
5,544,450 A 8/1996 Schmidt et al.
5,553,903 A 9/1996 Prete et al.
5,566,507 A 10/1996 Schmidt et al.
5,572,828 A 11/1996 Westfall
5,615,452 A 4/1997 Habbersett
5,632,117 A 5/1997 Prete et al.
5,632,118 A 5/1997 Stark
5,661,927 A 9/1997 Polowinczak et al.
5,669,180 A 9/1997 Maier
5,697,188 A 12/1997 Fullick et al.
5,699,636 A 12/1997 Stark
5,704,165 A 1/1998 Slocomb et al.
5,737,877 A 4/1998 Meunier et al.
5,802,767 A 9/1998 Slocomb et al.
5,806,243 A 9/1998 Prete et al.
5,806,900 A 9/1998 Bratcher et al.
5,829,196 A 11/1998 Maier
5,852,854 A 12/1998 Pierrot et al.
5,855,092 A 1/1999 Raap et al.
5,873,199 A 2/1999 Meunier et al.
5,924,243 A 7/1999 Polowinczak et al.
5,927,013 A 7/1999 Slocomb et al.
5,943,822 A 8/1999 Slocomb et al.
5,996,283 A 12/1999 Maier
6,032,417 A 3/2000 Jakus et al.
6,041,475 A 3/2000 Nidelkoff
6,041,476 A 3/2000 deNormand
6,041,550 A 3/2000 Tix
6,058,653 A 5/2000 Slocomb et al.
6,119,398 A 9/2000 Yates, Jr.
D434,637 S 12/2000 Habeck et al.
6,155,615 A 12/2000 Schultz
6,161,335 A 12/2000 Beard et al.
6,161,657 A * 12/2000 Zhuang ..... B60N 2/23 188/265
6,178,696 B1 1/2001 Liang
6,226,923 B1 5/2001 Hicks et al.
6,305,126 B1 10/2001 Hendrickson et al.
6,378,169 B1 4/2002 Batten et al.
6,393,661 B1 5/2002 Braid et al.

(56) References Cited

U.S. PATENT DOCUMENTS

D462,258 S 9/2002 Meunier
D464,256 S 10/2002 Meunier
6,467,128 B1 10/2002 Damani
6,470,530 B1 10/2002 Trunkle
D467,490 S 12/2002 Uken et al.
6,553,620 B2 4/2003 Guillemet et al.
6,584,644 B2 7/2003 Braid et al.
6,606,761 B2 8/2003 Braid et al.
6,622,342 B1 9/2003 Annes et al.
6,679,000 B2 1/2004 Uken et al.
6,763,550 B2 7/2004 Regnier
6,820,368 B2 11/2004 Uken et al.
6,840,011 B2 1/2005 Thompson et al.
6,848,148 B2 2/2005 Braid et al.
6,857,228 B2 2/2005 Kunz et al.
6,860,066 B2 3/2005 Kunz et al.
6,931,788 B2 8/2005 Uken et al.
6,983,513 B2 1/2006 Pettit
6,990,710 B2 1/2006 Kunz et al.
7,076,835 B2 7/2006 Harold et al.
7,143,475 B2 12/2006 Annes et al.
7,191,562 B2 3/2007 Uken et al.
7,552,510 B2 6/2009 Harold et al.
7,587,787 B2 9/2009 Pettit
7,673,372 B2 3/2010 Annes et al.
7,703,175 B2 4/2010 Tuller
7,735,191 B2 6/2010 Tuller
7,937,809 B2 5/2011 Tuller
7,945,994 B2 5/2011 Dallas et al.
7,966,770 B1 6/2011 Kunz
8,074,402 B2 12/2011 Tuller
8,132,290 B2 3/2012 Liang et al.
8,181,396 B1 5/2012 Kunz
8,313,310 B2 11/2012 Uchikado
8,365,356 B2 2/2013 Robertson
8,371,068 B1 2/2013 Kunz
8,424,248 B2 4/2013 Uken et al.
8,505,242 B1 8/2013 Kunz
8,539,642 B2 9/2013 Baker
8,561,260 B2 * 10/2013 Baker ..... E05D 13/1276 16/193
8,640,383 B1 2/2014 Kunz
8,813,310 B2 8/2014 Baker et al.
8,819,896 B2 9/2014 Kellum, III et al.
8,850,745 B2 10/2014 Sofianek et al.
8,918,979 B2 12/2014 Baker
RE45,328 E 1/2015 Tuller
8,966,822 B2 3/2015 Sofianek et al.
9,003,710 B2 4/2015 Kellum, III et al.
9,121,209 B2 9/2015 Baker et al.
9,133,656 B2 9/2015 Steen et al.
9,458,655 B2 10/2016 deNormand
9,580,950 B2 2/2017 Uken et al.
10,208,517 B2 * 2/2019 Lucci ..... E05D 15/18
10,344,514 B2 * 7/2019 Uken ..... E05D 13/08
2002/0053117 A1 5/2002 Braid et al.
2002/0092241 A1 7/2002 Uken et al.
2002/0104189 A1 8/2002 Braid et al.
2002/0129463 A1 9/2002 Newman
2003/0074764 A1 4/2003 Pettit et al.
2003/0192147 A1 10/2003 Braid et al.
2003/0192257 A1 10/2003 Uken et al.
2003/0213096 A1 11/2003 Annes et al.
2004/0006845 A1 1/2004 Polowinczak et al.
2004/0163209 A1 8/2004 Pettit
2004/0216380 A1 11/2004 Uken et al.
2004/0237256 A1 12/2004 Lutfallah
2004/0244158 A1 12/2004 Awakura et al.
2004/0244295 A1 * 12/2004 Derham ..... E05F 15/41 49/362
2005/0055802 A1 3/2005 Braid et al.
2005/0178068 A1 8/2005 Uken et al.
2005/0198775 A1 9/2005 Pettit et al.
2005/0229492 A1 10/2005 Robertson
2006/0086052 A1 4/2006 Petta et al.
2006/0207185 A1 9/2006 Shuler et al.
2007/0011846 A1 1/2007 Braid et al.
2007/0101654 A1 5/2007 Robertson
2007/0113479 A1 5/2007 Uken et al.
2008/0047099 A1 2/2008 Malek
2008/0120804 A1 5/2008 Annes et al.
2008/0178424 A1 7/2008 Tuller
2008/0178425 A1 7/2008 Tuler
2009/0188075 A1 7/2009 Baker
2009/0260295 A1 10/2009 Tuller
2010/0115854 A1 5/2010 Uken et al.
2011/0067314 A1 3/2011 Baker
2011/0239402 A1 10/2011 Steen et al.
2012/0297687 A1 11/2012 Baker et al.
2013/0283699 A1 10/2013 Kellum, III et al.
2013/0340349 A1 12/2013 Baker
2014/0000172 A1 1/2014 Sofianek
2014/0026490 A1 1/2014 Baker et al.
2014/0208653 A1 7/2014 Sofianek et al.
2014/0208655 A1 7/2014 Stoakes et al.
2014/0259524 A1 * 9/2014 Kellum, III ..... E05D 13/1276 16/197
2014/0259936 A1 9/2014 DeNormand et al.
2014/0331561 A1 11/2014 Baker et al.
2015/0167379 A1 6/2015 Sofianek et al.
2015/0361701 A1 * 12/2015 Steen ..... E05D 13/1276 49/506
2015/0368952 A1 12/2015 Baker et al.
2016/0222709 A1 * 8/2016 Wynder ..... E05D 15/16
2016/0298368 A1 * 10/2016 Kunz ..... E05D 13/08
2016/0298369 A1 * 10/2016 Kunz ..... E05D 13/04
2017/0089109 A1 3/2017 Steen et al.
2017/0211305 A1 7/2017 Uken et al.
2017/0370138 A1 12/2017 Uken et al.
2018/0291660 A1 * 10/2018 Kellum ..... E05D 13/1276
2019/0085609 A1 3/2019 Kellum

FOREIGN PATENT DOCUMENTS

CA 2382933 4/2002
CA 2338403 4/2006
CA 2596293 2/2008
CA 2619267 7/2008
CA 2619289 7/2008
CA 2820240 1/2014
CA 2836375 7/2014
DE 4211695 10/1992
GB 329996 5/1930
GB 723056 2/1955
GB 740223 11/1955
GB 1505782 3/1978
GB 2195691 4/1988
GB 2236786 4/1991
GB 2254875 10/1992
GB 2276655 10/1994
GB 2278626 12/1994
GB 2280697 2/1995
GB 2292168 2/1996
GB 2295634 6/1996
JP 56-171982 1/1981
JP 03197785 8/1991
JP 5-52273 7/1993
JP 3025244 6/1996
JP 63-3785 1/1998
JP 2000283025 10/2000
JP 2004293388 10/2004
JP 2005113907 4/2005

OTHER PUBLICATIONS

"Request for Ex Parte Reexamination of U.S. Pat. No. 9,133,656 Pursuant to 37 CFR 1.510 et seq", in U.S. Appl. No. 13/081,089, entitled Inverted Constant Force Window Balance for Tilt Sash, filed Feb. 26, 2016, 19 pgs.

Balance Systems—BSI Amesbury Group, Inc. Crossbow Balance Advertisement dated Jun. 7, 1999 (3 pgs.).

(56) References Cited

OTHER PUBLICATIONS

BSI Tilt Balance Systems, Balance Systems—BSI, Amesbury Group, Inc., 1996-2001, 4 pgs.
BSI's Hidden Advantage: It's as Easy as 1-2-3, Balance Systems—BSI, Amesbury Group, Inc., 2001, 3 pgs.
Response by Patent Owner to Office Action in Ex-Parte Re-Examination Pursuant to 37 C.F.R. 1.550(e) for co-pending U.S. Appl. No. 90/013,695, filed Aug. 23, 2016, 13 pages.
Crossbow Balance! Another New Balance in BSI's Quiver, Balance Systems—BSI, Amesbury Group, Inc., Jun. 7, 1999, 2 pgs.
Dakota Balance—Balances and Accessories Brochure, May 2001, 2 pgs.
DWM Door & Window Maker Magazine, "2004 Annual Buyers Guide", vol. 5, Issue 3, Apr. 2004, 2 pgs.
Ex-Parte Re-Examination Office Action for corresponding Re-Examination U.S. Appl. No. 90/013,695 dated Jun. 23, 2016, 8 pgs.
Heinberg, "Latest Trends in Window and Door Hardware," Shelter Magazine, Jul. 2001, cover and p. 11.
PCT International Search Report, Written Opinion, and International Preliminary Report on Patentability (with 37 sheets of annexes) for PCT/US2011/024134; ISA/US, dated Feb. 9, 2011 (113 pages total).
Photographs of the Crossbow Balance Component shown in C6 (7 views; 3 pgs).

* cited by examiner

CONSTANT FORCE WINDOW BALANCE ENGAGEMENT SYSTEM

PRIORITY CLAIM

This application claims priority to and the benefit of U.S. Provisional Patent Application Ser. No. 62/258,216, filed on Nov. 20, 2015, the disclosure of which is hereby incorporated herein by reference in its entirety.

INTRODUCTION

Inverted constant force window balance systems include a housing or shoe coupled to a window sash that carries a coil spring having a free end secured to a window jamb channel with a mounting bracket, screw, or other element. As the coil spring unwinds, the recoil tendency of the spring produces an upward force to counter the weight of the window sash. The shoe may be a tilt-in shoe that allows the window sash to tilt inwards for cleaning and/or installation/removal purposes. As the window sash tilts, a locking mechanism holds the shoe in place to prevent the coil spring from retracting the shoe in the absence of the weight of the sash.

SUMMARY

In one aspect, the technology relates to a window balance system having: a mounting bracket configured to be secured to a window jamb; a shoe body; a coil spring movably coupling the mounting bracket to the shoe body; an engagement member extending from at least one of the mounting bracket and the shoe body, wherein the engagement member includes at least one resilient arm having a pawl extending therefrom; and a receiving member defined in at least the other one of the mounting bracket and the shoe body, wherein the receiving member includes at least one rack having at least one tooth extending therefrom such that the pawl is engageable with the rack.

In an example, the mounting bracket and the shoe body define a longitudinal axis. In another example, the at least one resilient arm extends longitudinally from an end portion of the shoe body and the pawl includes an enlarged end of the at least one resilient arm. In yet another example, the engagement between the pawl and the rack deflects the resilient arm in a direction toward and away from the longitudinal axis. In still another example, the at least one rack is disposed at an angle in relation to the longitudinal axis. In another embodiment of the above aspect, the angle is within a range between and including 0° and 15°. In an example, the engagement member includes a first resilient arm and a second resilient arm, wherein each pawl faces in an opposite direction. In another example, the receiving member includes a first rack and a second rack, wherein each at least one tooth faces in an opposite direction. In yet another example, the shoe body includes a carrier configured to receive a curled portion of the coil spring. In still another example, the engagement member extends from the mounting bracket and the receiving member is defined in the shoe body. In another embodiment of the above aspect, the at least one rack includes a pair of facing toothed structures defining a channel therebetween, the channel configured to receive the pawl therein. In an example, the engagement member includes a body coupled to the shoe body.

In another aspect, the technology relates to a window balance system having: a shoe body including: an end portion; and a pair of resilient arms extending from the end portion, each resilient arm having a pawl extending therefrom; and a mounting bracket including a pair of racks, each rack having a plurality of teeth extending therefrom such that each pawl is engageable with the corresponding rack.

In an example, a coil spring is configured to couple the shoe body to the mounting bracket. In another example, the pair of racks are disposed on facing surfaces of the mounting bracket. In yet another example, the pawl includes an angled tooth extending away from an elongate axis of the resilient arm. In still another example, the angled tooth includes a leading angular face and a trailing angular face, the trailing angular face is configured to engage with the plurality of teeth. In another embodiment of the above aspect, the pawl is configured to engage with any one of the plurality of teeth.

In another aspect, the technology relates to a window balance system having: a shoe body; a mounting bracket; and a ratchet system configured to releasably couple the shoe body to the mounting bracket, the ratchet system having: at least one static receiving member; and at least one pawl configured to selectively engage with the at least one static receiving member via a resilient retaining force.

In an example, the at least one pawl extends from a resilient arm coupled to at least one of the shoe body and the mounting bracket, the resilient arm configured to induce the resilient retaining force. In another example, the ratchet system further includes a pair of resilient arms. In yet another example, the at least one pawl extends from the pair of resilient arms in different directions. In still another example, the at least one static receiving member includes a pair of dog bone members, the pair of dog bone members defined in at least one of the shoe body and the mounting bracket.

In another aspect, the technology relates to a window balance system having: a shoe body including at least one static receiving member extending therefrom; an engagement member configured to couple to the shoe body via the at least one static receiving member, the engagement member includes a pair of resilient arms extending therefrom, each resilient arm having a pawl extending from a free end of the resilient arm; and a mounting bracket including a pair of racks, each rack having a plurality of teeth extending therefrom such that each pawl is engageable with the corresponding rack.

In an example, the at least one static receiving member includes a pair of dog bone members. In another example, the engagement member further includes a pair of recesses that correspond to the pair of dog bone members. In yet another example, the engagement member is removably coupled to the shoe body.

BRIEF DESCRIPTION OF THE DRAWINGS

There are shown in the drawings embodiments that are presently preferred, it being understood, however, that the invention is not limited to the precise arrangements and configurations shown.

DETAILED DESCRIPTION

The technologies described herein facilitate a spring coil of a constant force window balance system to be held close to a mounting bracket when mounted in a window frame, when a window sash is in a raised position. For example, a ratchet system or engagement mechanism is defined in the window balance system so as to releasably engage a shoe body with the mounting bracket. As such, when the window sash is in a raised position the window sash load is at least partially transferred from the spring coil to the ratchet system and restricts the window sash from lowering. Moreover, the ratchet system further facilitates forming a more secure coupling between the shoe body and the mounting bracket during shipping and window assembly, thereby reducing undesirable wear to the system before operation within the window. For example, the ratchet system includes a toothed interface between the stationary mounting bracket and the shoe body (e.g., an upper portion thereof) so as to provide sash support over a wide range of sash travel. The ratchet system also serves as a sash travel stop, thus preventing the sash from being raised too high in the window frame which, in an extreme example, can cause undesirable impact between a frame header and a lock positioned on an upper portion of the window sash, potentially inducing wear to a header. In a more specific example, the technology includes dual opposing lock fingers or resilient arms included on the shoe body and having a pawl or a tooth extending therefrom. The pawl engages the dual opposing racks having a plurality of teeth extending therefrom and defined in the mounting bracket, such that the shoe body is releasably engaged with the mounting bracket.

Figure 1:
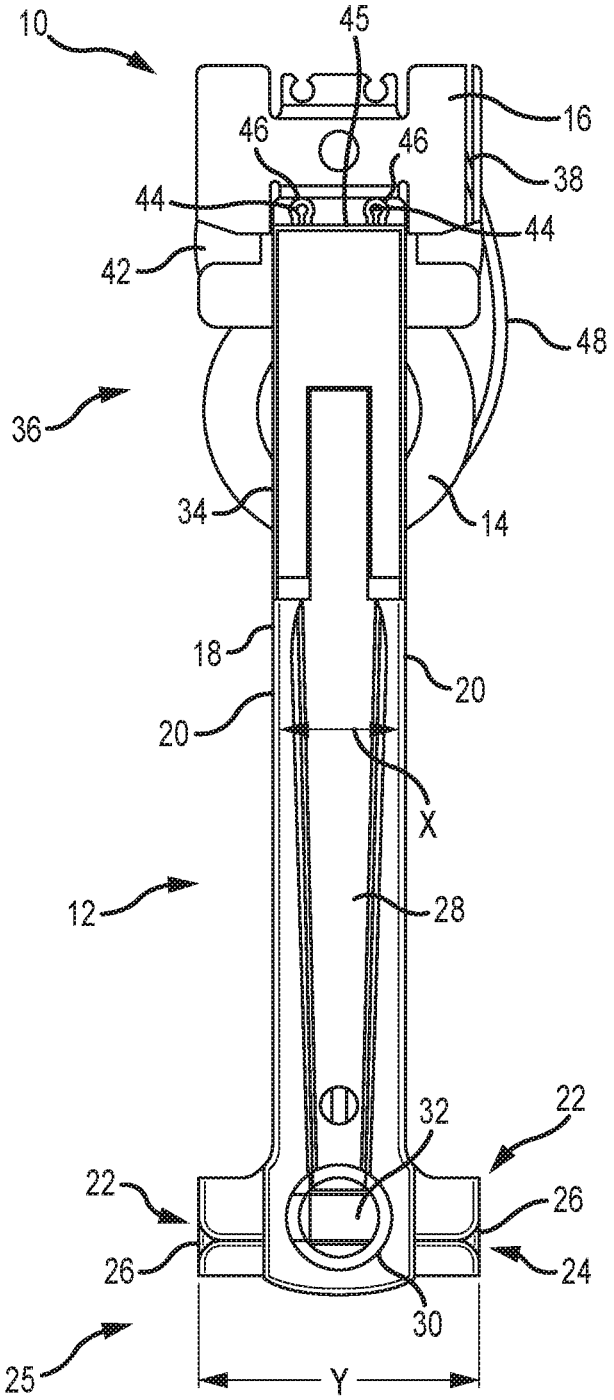
FIG. 1 PRIOR ART
FIG. 1 is a front view of a prior art inverted constant force window balance system.

FIG. 1 is a front view of a prior art window balance system 10, as described in U.S. Pat. No. 9,133,656, the disclosure of which is hereby incorporated by reference herein in its entirety. Elements of the window balance system 10 include a shoe body 12, a coil spring 14, and a mounting bracket 16. The shoe body 12 may incorporate a generally T-shaped configuration that is similar in certain aspects to a balance shoe described in U.S. Pat. No. 6,679,000, the disclosure of which is hereby incorporated by reference herein in its entirety. The T-shaped shoe configuration may utilize an elongate portion 18 having two side walls 20 defining an elongate portion width X therebetween. Two opposing projections 22 may extend beyond the side walls 20 of the elongate portion 18 and form an enlarged portion 24 at a distal end 25 of the shoe body 12. The projections 22 may each include a projection side wall 26 that define an enlarged portion width Y therebetween.

The shoe body 12 may define a longitudinal groove 28 that receives and permits passage of a pivot bar from a window sash (both not shown). Some known inverted constant force balances often require that the sash frame or jamb be spread apart in order to load the sash into the shoes on either side of the frame. This may make the sash insertion more difficult during manufacture as well as in the field. With the depicted balance, however, the shoe may have a grooved lead-in that allows "drop in" of the pivot bar during sash installation. This may facilitate faster installation and removal of the window sash in both a production environment and in the field. The groove 28 may be open at the bottom proximate a cam 30 that is located within the enlarged portion 24 of the shoe 12. The cam 30 may include a keyhole opening 32 for receipt of the pivot bar, when the keyhole opening 32 is rotationally aligned with the groove 28. During installation of the sash, the pivot bar may slide from the groove 28 directly into the keyhole opening 32 and in the cam 30. The coil spring 14 may be carried in a carrier section 34 positioned near an upper portion 36 of the elongate portion 18 of the shoe body 12. A free end 38 of the coil spring 14 may be secured to the mounting bracket 16 that is securable to a window jamb channel with a screw or other element (not shown). Alternatively, the free end 38 may be secured directly to the jamb channel.

A sweep 42, manufactured of pile, foam, or other low-friction material may be installed on either side of the elongate portion 18 such that the sweep 42 projects beyond the side wall 20 of the elongate portion 18 and positioned adjacent to the coil spring 14. Dirt and debris (e.g., gypsum dust, sawdust, sand, etc.) are common in construction and can reduce operability of the coil spring 14. The sweep 42 may wipe the coil spring 14 during each sash opening and closing cycle along the parallel sides of the jamb track, thus reducing dirt and debris from being drawn into the coil spring 14, which can result in undesirable friction and operational problems.

Additionally, one or more posts 44, for example two posts 44, extend from a top side 45 of the elongate portion 18. These posts 44 engage with corresponding recesses 46 defined in the mounting bracket 16 to couple mounting bracket 16 to shoe body 12, and remain engaged during shipping and/or window assembly, prior to mounting of the window sash. The engagement between the posts 44 and the recesses 46 holds together the window balance system 10, for example, coupling the mounting bracket 16 to the shoe body 12, so as to avoid and reduce inadvertent disengagement during shipping and/or window assembly. However, some known window balance systems, for example the system 10, are roughly handled during shipping and/or window assembly such that the posts 44 may become disengaged from the recesses 46 and the mounting bracket 16 is decoupled from the shoe body 12. This decoupling may increase undesirable wear to the window balance system 10, thus undesirably frustrating the window assembly process.

During operation of the window balance system 10, the coil spring 14 forms a curve 48 of coil spring material between the coil spring 14 and the mounting bracket 16, as shown in FIG. 1. Once the window sash is loaded onto the window balance system 10, the weight of the window sash pulls the shoe body 12 in a downward direction and away from the mounting bracket 16. This downward movement of the shoe body 12 disengages the posts 44 from the recesses 46 and ultimately straightens the curve 48 of the coil spring 14. At this point, the coil spring 14 now bears the weight of the window sash. However, this downward movement also lowers the window sash, which may reduce the egress area of the window or impede egress therethrough.

The constant force balance system 10 requires the coil spring 14 to be extended a certain distance in order to provide enough lift to meet its specified weight capacity. For example, this distance may be about one inch. Thus, if a lower sash of a hung window is opened to its fullest extent and released, it may drop by about one inch until the coil spring 14 offers sufficient resistance to the load of the window sash. This limits the sash opening and the ability to meet safety egress with some known window sizes. For example, the drop of the window sash, induced by the window balance system 10, may limit the total amount of egress area available, thus preventing the window from being rated to a proper egress standard. Some known windows require a clear projected open area for egress is about 5.7 square feet, with the vertical opening being no less than 20 inches and the horizontal opening being no less than 24 inches. As such, some known window balance systems induce the window to drop unexpectedly upon opening to its fullest extent and potentially impeding the egress of a person as they try to pass through the window.

Figure 2A:
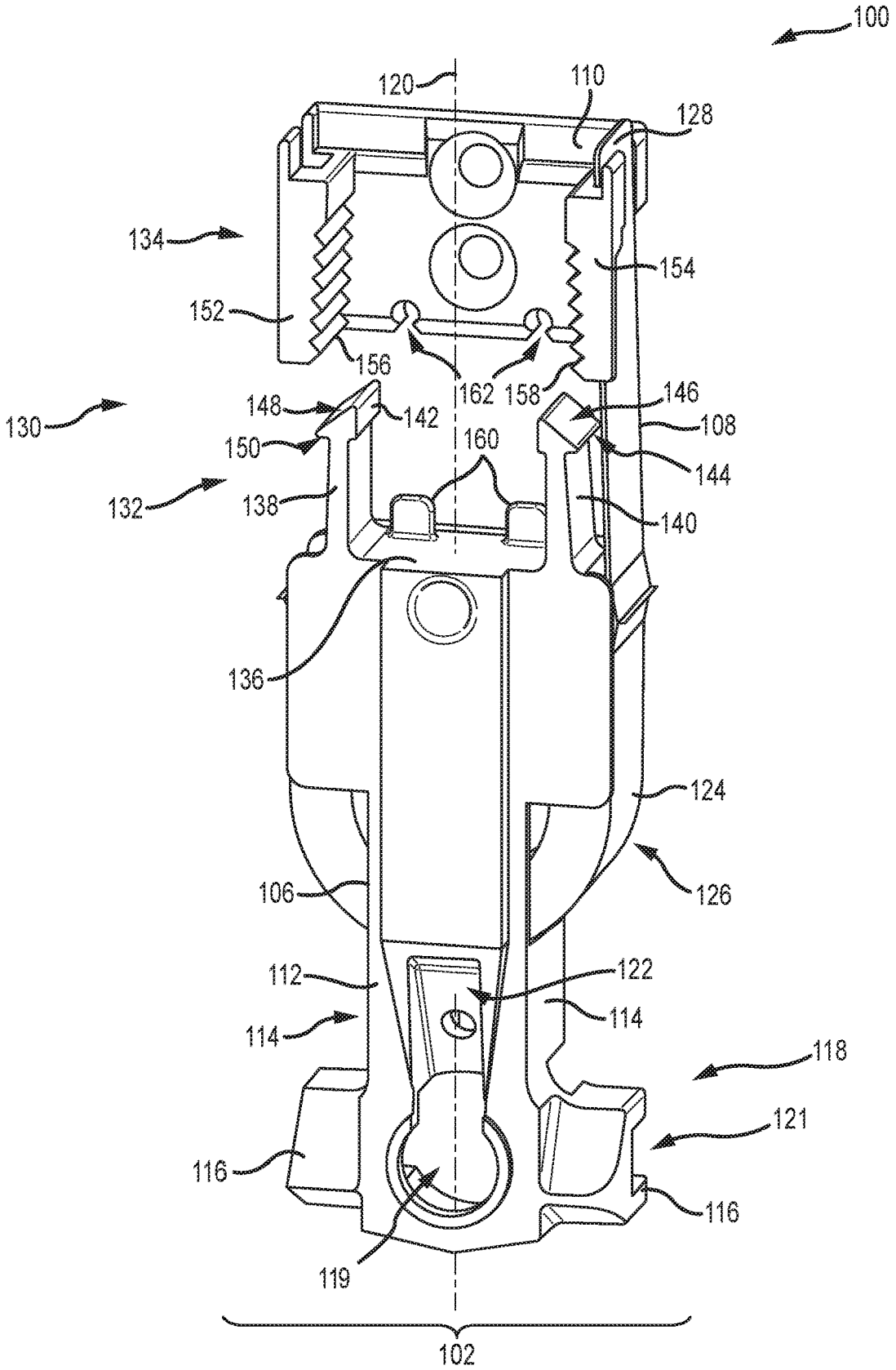
FIGS. 2A and 2B are front perspective views of an example of an inverted constant force window balance system, in a disengaged and an engaged position, respectively.
Figure 2B:
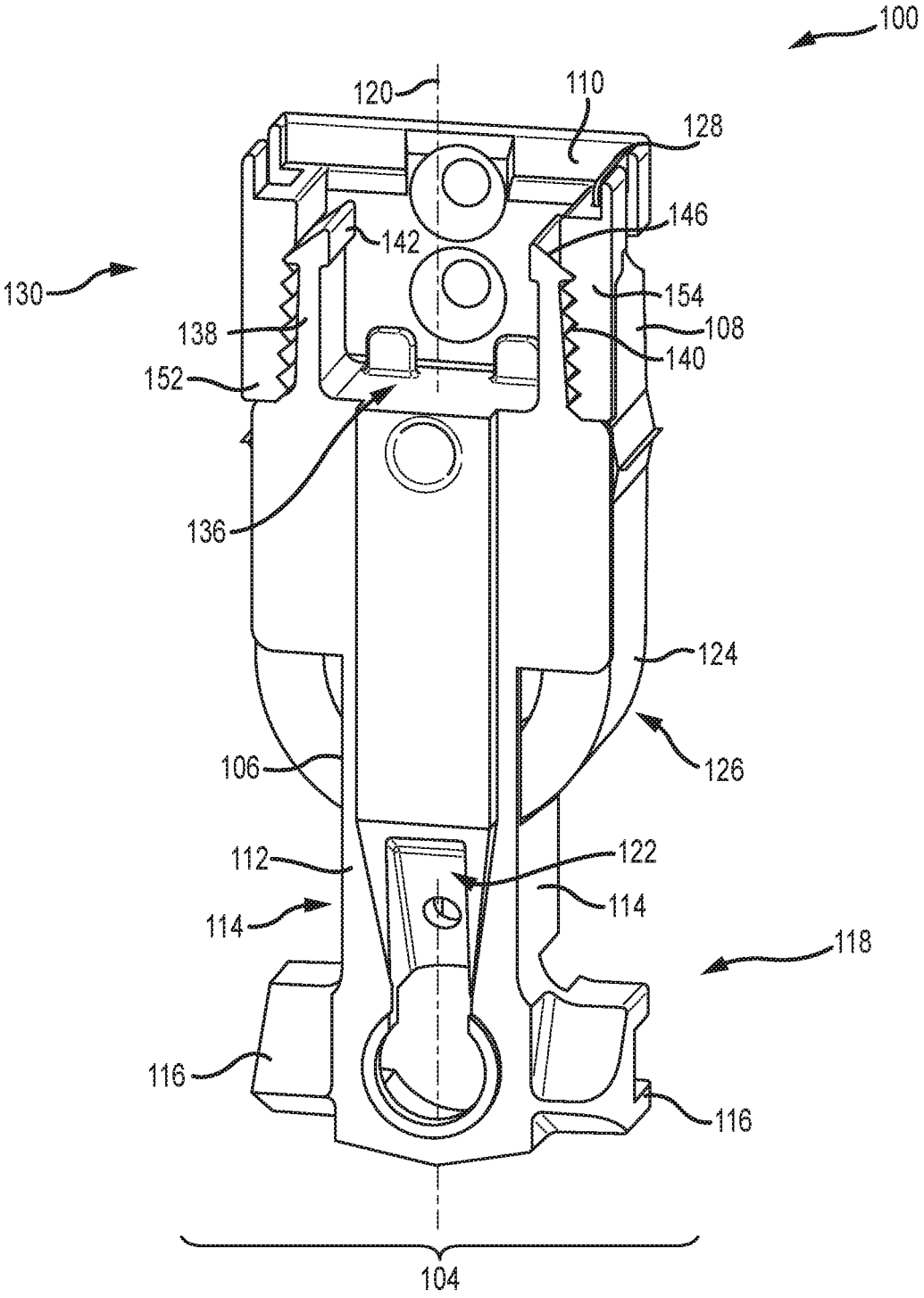

FIGS. 2A and 2B are front perspective views of an example of an inverted constant force window balance system 100, in a disengaged position 102 and an engaged position 104, respectively. With reference to FIGS. 2A and 2B, the window balance system 100 includes a shoe body 106, a coil spring 108, and a mounting bracket 110. The coil spring 108 movably couples the shoe body 106 to the mounting bracket 110. The shoe body 106 may be secured to a window sash (not shown) with screws, bolts, or other mechanical or chemical fasteners (adhesives) and includes an elongate portion 112 having two side walls 114. Two opposing projections 116 extend beyond the side walls 114 of the elongate portion 112 and form an enlarged portion 118. The enlarged portion 118 may define an opening 119 that encloses a locking mechanism (not shown) that includes, for example, a cam (as shown in FIG. 1). The locking mechanism may include locking elements (not shown) that extend outwards from side openings 121 defined in projections 116 upon rotation of the cam, as known in the art. The shoe body 106 and the mounting bracket 110 define a longitudinal axis 120. A longitudinal groove 122 is defined within the elongate portion 112 of the shoe body 106 and extends along the longitudinal axis 120. As described above, the longitudinal groove 122 enables a pivot pin (not shown) connected to the window sash to be dropped into the locking mechanism. The shoe body 106 also includes a coil carrier 124 formed therein that receives a curled portion 126 of the coil spring 108.

The shoe body 106 is coupled to the mounting bracket 110 via the coil spring 108. More specifically, a free end 128 of the coil spring 108 is engaged with the mounting bracket 110. As such, the curled portion 126 provides a retraction force along the longitudinal axis 120 for the shoe body 106 and the connected window sash in relation to the mounting bracket 110 and the free end 128. The mounting bracket 110 may be secured to a jamb channel (not shown) of a window frame with screws, bolts, or other mechanical or chemical fasteners (adhesives).

Additionally, window balance system 100 also includes an engagement mechanism/ratchet system 130 defined and/or formed on at least one of the shoe body 106 and the mounting bracket 110. The ratchet system 130 enables the shoe body 106 to be releasably coupled to the mounting bracket 110 in a plurality of predetermined positions. The ratchet system 130 includes an engagement member 132 and a receiving member 134. The engagement member 132 extends from an end portion 136 of the shoe body 106 along the longitudinal axis 120. The engagement member 132 includes at least one resilient arm, for example, a first and a second resilient arm 138 and 140, respectively. Each resilient arm 138 and 140 has a pawl 142 and 144 extending therefrom and disposed at a free end that facilitates engagement with the receiving member 134. For example, each pawl 142 and 144 defines an enlarged end of the resilient arms 138 and 140, respectively. More specifically, each pawl 142 and 144 includes an angled tooth 146 that extends away from an elongate axis of the resilient arms 138 and 140. The angled tooth 146 may include a leading angular face 148 that enables engagement with the receiving member 134, and also may include a relatively steeper trailing angular face 150 that enables the engagement with the receiving member 134 to be maintained. As such, the shoe body 106 is positioned adjacent to the mounting bracket 110 when the engagement member 132 is engaged with the receiving member 134.

The receiving member 134 is defined on facing surfaces of the mounting bracket 110 and includes at least one linear serration element/rack, for example, a first and a second rack 152 and 154. Each rack 152 and 154 has a plurality of teeth 156 and 158 extending therefrom and along a longitudinal length of the racks 152 and 154. For example, each rack 152 and 154 with teeth 156 and 158 corresponds to each resilient arm 138 and 140 with pawls 142 and 144, such that pawls 142 and 144 are engageable with racks 152 and 154. As shown in FIGS. 2A and 2B, teeth 156 and 158 face in opposite directions and extend towards the longitudinal axis 120, and pawls 142 and 144 face in opposite directions and extend away from the longitudinal axis 120. In alternative examples, the engagement member 132 and the receiving member 134 are defined in any other orientation that enables the window balance system 100 to function as described herein. For example, teeth 156 and 158 may extend away from the longitudinal axis 120. In other examples, the rack 152 and/or 154 may be formed in the same portion of the mounting bracket 110 that is attachable to the window jamb. Such configurations require the ratchet system 130 to be appropriately located, as would be apparent to a person of skill in the art.

Furthermore, in some examples, the window balance system 100 may include at least one projection 160 extending from the end portion 136 of the shoe body 106 and at least one corresponding recess 162 defined within the mounting bracket 110. The projections 160 are engageable with the recesses 162 as described above in reference to FIG. 1. In other examples, projections 160 and recesses 162 are omitted.

In operation, the window balance system 100 is installed into a window frame (not shown). More specifically, the mounting bracket 110 is mounted to a window jamb, while the shoe body 106 is mounted to a window sash. When the window sash is in a closed or partially closed position the window balance system 100 is in the disengaged position 102 as shown in FIG. 2A. As such, the coil spring 108 is extended and induces a biasing force from the shoe body 106 in a direction towards the mounting bracket 110 along the longitudinal axis 120. This biasing force facilitates reducing a lifting force, from the weight of the window sash, required to raise the window sash into an open or more open position.

As the window sash is raised into a fully-opened position, the engagement member 132 is received by the receiving member 134 to releasable couple the shoe body 106 to the mounting bracket 110. By coupling the shoe body 106 to the mounting bracket 110, via the ratchet system 130, the weight of the window sash is at least partially supported by the window balance system 100 such that the window sash is held in the fully-opened position. When the engagement member 132 is received by the receiving member 134, the leading angular face 148 of each pawl 142 and 144 deflects the resilient arm 138 and 140 such that the pawls 142 and 144 pass around each tooth 156 and 158 and the trailing angular face 150 engages and disengages with the individual teeth 156 and 158. Resilient arms 138 and 140 may deflect, for example, flex, without being permanently deformed. The deflection of the resilient arms 138 and 140 may be in a direction towards and away from the longitudinal axis 120.

FIG. 2B shows the window balance system 100 in the engaged position 104. In the engaged position 104, deflection of the resilient arms 138 and 140 induce a retaining force that is normal to the longitudinal axis 120 such that the pawls 142 and 144 are engaged with the racks 152 and 154 coupling the shoe body 106 to the mounting bracket 110, thus enabling the window sash to be held in the fully-opened position. More specifically, the resilient arms 138 and 140 are positioned on the shoe body 106 such that as the arms 138 and 140 are received by the racks 152 and 154, the resilient arms 138 and 140 deflect out of the original disengaged position. As such, the resilience of arms 138 and 140 induce the retaining force that urges the arms 138 and 140 to return the original position. For example, the retaining force engages the pawls 142 and 144 with the racks 152 and 154 and the trailing angular face 150 restricts the pawls 142 and 144 from disengaging, thus coupling the shoe body 106 to the mounting bracket 110.

The trailing angular face 150 may engage with any one of the plurality of teeth 156 and 158 along racks 152 and 154. For example, the pawls 142 and 144 may engage at a first tooth on racks 152 and 154, or the pawls 142 and 144 may engage at a last tooth on racks 152 and 154. While is still other examples, more than one pawl 142 and 144 may extend from each resilient arm 138 and 140 such that more than one tooth on a single rack may be engaged.

When the engagement member 132 is engaged with the receiving member 134, the engagement enables the ratchet system 130 to support at least a portion of the weight of the window sash. As such, when the window sash is raised to the fully-opened position, the coil spring 108 is not required to be in an extended position and may take on a curved configuration, for example the curve 48 (shown in FIG. 1). By supporting the weight of the window sash through the ratchet system 130, the egress of the window will be maintained and the window sash will not partially drop in the fully-opened position. The ratchet system 130 further enables the engagement member 132 to disengage with receiving member 134 upon a disengagement force being induced along the longitudinal axis 120. The disengagement force is sufficient to overcome the retaining force that engages the pawls 142 and 144 with the racks 152 and 154 so as to defect the resilient arms 138 and 140 and disengage the engagement member 132 from the receiving member to facilitate closing the window sash within the window.

Also, the ratchet system 130 serves as a sash travel stop, thus preventing the window sash from being raised too high in the window frame which may cause undesirable impact between a frame header and a lock positioned on an upper portion of the window sash and inducing wear to the header. Moreover, the balance window system 100 may be shipped and installed in the engaged position 104, depicted in FIG. 2B, so as to reduce undesirable wear to the system 100 before operation within the window. The ratchet system 130 forms a more secure coupling between the shoe body 106 and the mounting bracket 110 such that undesirable decoupling during shipping and/or window assembly is decreased.

Figure 3:
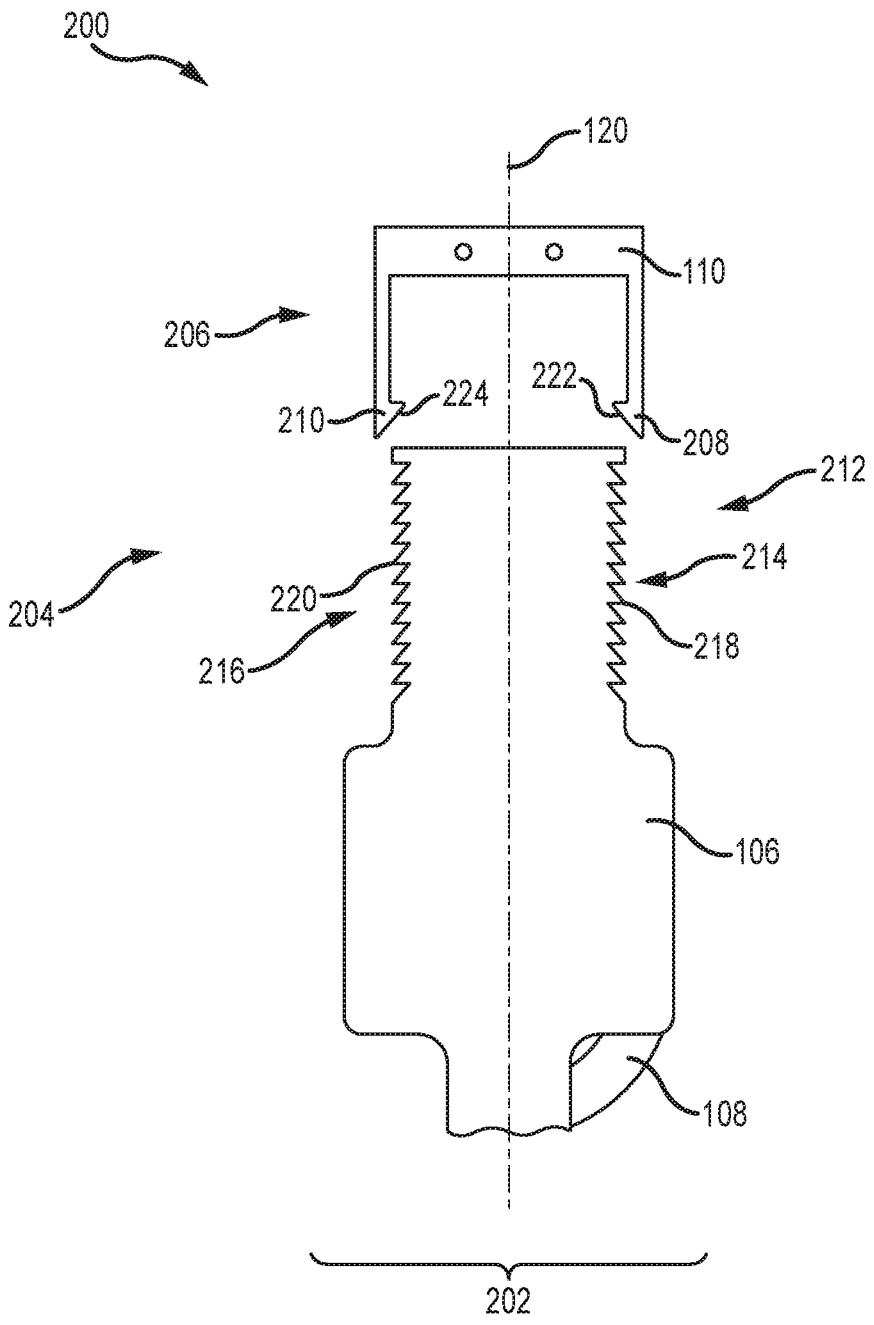
FIG. 3 is a partial front view of another inverted constant force window balance system, in a disengaged position.

In the example of FIGS. 2A and 2B, the resilient arms 138 and 140 are disposed on the shoe body 106, while the fixed racks 152 and 154 are disposed on the mounting bracket 110. FIG. 3 is a partial front view of another inverted constant force window balance system 200, in a disengaged position 202. Similar to the window balance system 100 (shown in FIGS. 2A and 2B), the window balance system 200 includes the shoe body 106, the coil spring 108, and the mounting bracket 110. However, in this example, a ratchet system 204 defined therein may be oppositely configured, such that an engagement member 206, including resilient arms 208 and 210, extend from the mounting bracket 110, while a receiving member 212, including fixed racks 214 and 216, is integral with and defined in the shoe body 106. For example, a plurality of teeth 218 and 220 extending from racks 214 and 216, respectively, face in opposite directions and extend away from the longitudinal axis 120, and pawls 222 and 224 extending from resilient arms 208 and 210, respectively, face in opposite directions and extend towards the longitudinal axis 120. In alternative examples, the engagement member 206 and the receiving member 212 are defined in any other orientation that enables the window balance system 200 to function as described herein.

During operation of the window balance system 200, the shoe body 106 and the mounting bracket 110 are enabled to be movably positioned in relation to one another along the longitudinal axis 120 as described above in further detail. When engaging the engagement member 206 with the receiving member 210 such that the window balance system 200 is in an engaged position (not shown), resilient arms 208 and 212 deflect during engagement with the racks 214 and 216, respectively. In other examples, the arms are fixed and/or static and each tooth is resilient, as such each tooth may deflect when engaged and disengaged with the corresponding static pawl and induce the retaining force within the ratchet system. In yet further contemplated examples, opposite and/or both sets of teeth and arms/pawls may be resilient and deflect thus inducing the retaining force within the ratchet system.

Figure 4B:
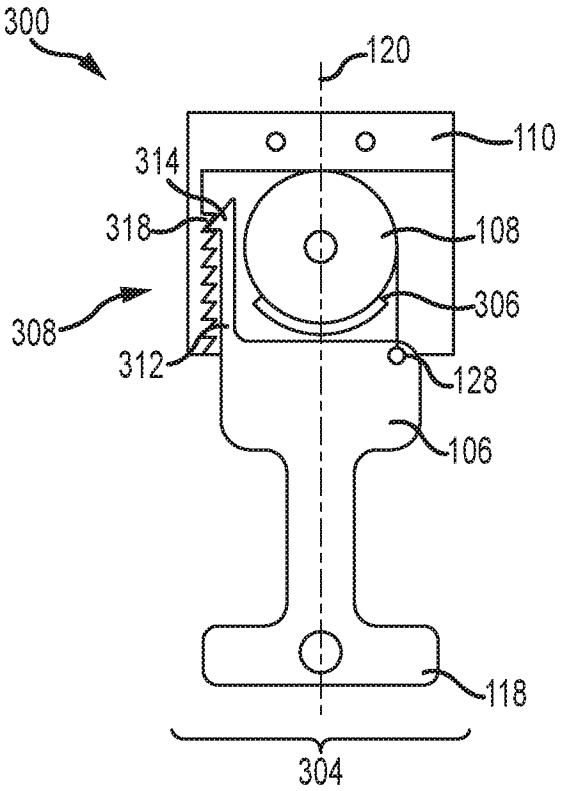
FIGS. 4A and 4B are front views of an example of a constant force window balance system, in a disengaged and an engaged position, respectively.
Figure 4A:
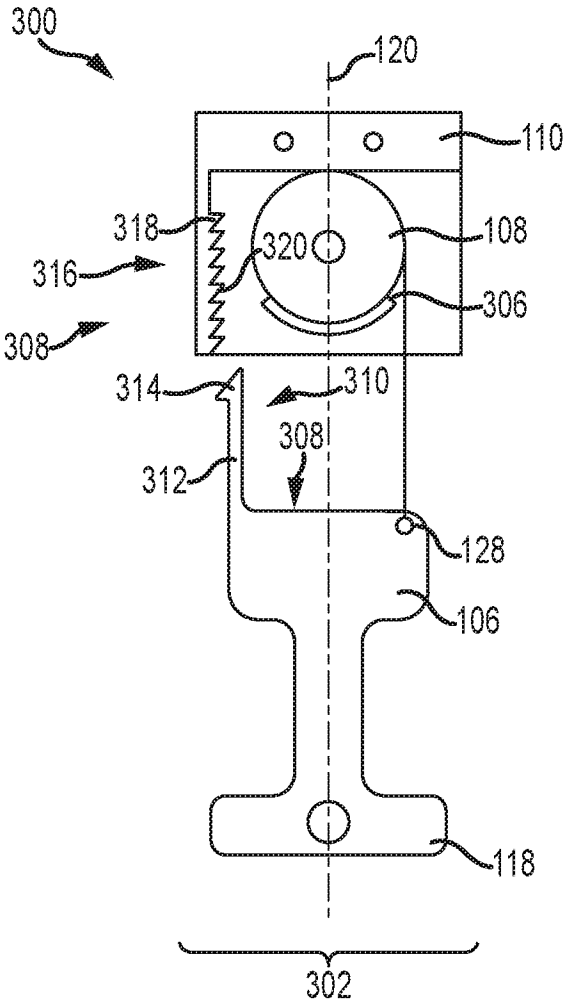

FIGS. 4A and 4B are front views of an example of a constant force window balance system 300, in a disengaged position 302 and an engaged position 304, respectively. Similar to the window balance systems described above, the window balance system 300 includes the shoe body 106, the coil spring 108, and the mounting bracket 110. However, in this example, a coiled portion of the coil spring 108 is received in a coil carrier 306 disposed in the mounting bracket 110. With reference to both FIGS. 4A and 4B, the window balance system 300 includes the mounting bracket 110 having the coil carrier 306 formed therein. The free end 128 of the coil spring 106 is coupled to the shoe body 106 at an end surface 308 opposite the enlarged portion 118 forming the biasing force/retraction force for the shoe body 106 and the window sash coupled thereto. Placement of the coil spring 108 is the difference between the inverted constant force balance systems 100 and 200 of FIGS. 2A-3 and the constant force balance system 300 of FIGS. 4A and 4B. In the constant force balance system 300 of FIGS. 4A and 4B, the spring coil 108 is stationary on the mounting bracket 110 and thus does not move with the window sash. Regardless, the engagement/ratchet systems described herein may be used on both inverted constant force balance systems and standard constant force balance systems.

The window balance system 300 also includes a ratchet system 308. For example, ratchet system 308 includes an engagement member 310 having a resilient arm 312 extending from the shoe body 106 and a pawl 314 positioned at a free end. Ratchet system 308 also includes a receiving member 316 having a rack 318 defined therein and a plurality of teeth 320 extending therefrom. In the depicted example, a single resilient arm 312 is engageable with the rack 318. In alternative examples, multiple arms and racks may be included as described in the previous examples. Additionally, the arm 312 and the rack 318 may be disposed on either side of the longitudinal axis 120 and with the pawl 314 and the teeth 320 facing in any direction that enables the ratchet system 308 to function as described herein.

During operation of the window balance system 300, the shoe body 106 and the mounting bracket 110 are enabled to be movably positioned in relation to one another along the longitudinal axis 120 as described above in further detail. When engaging the engagement member 310 with the receiving member 316, the resilient arms 312 deflect during engagement with the rack 318. While in the engaged position 304, the ratchet system 308 enables the window sash to be held in the fully-opened position when installed within the window, and also facilitates maintaining the shoe body 106 in contact with the mounting bracket 110 during shipping and window assembly.

Figure 5:
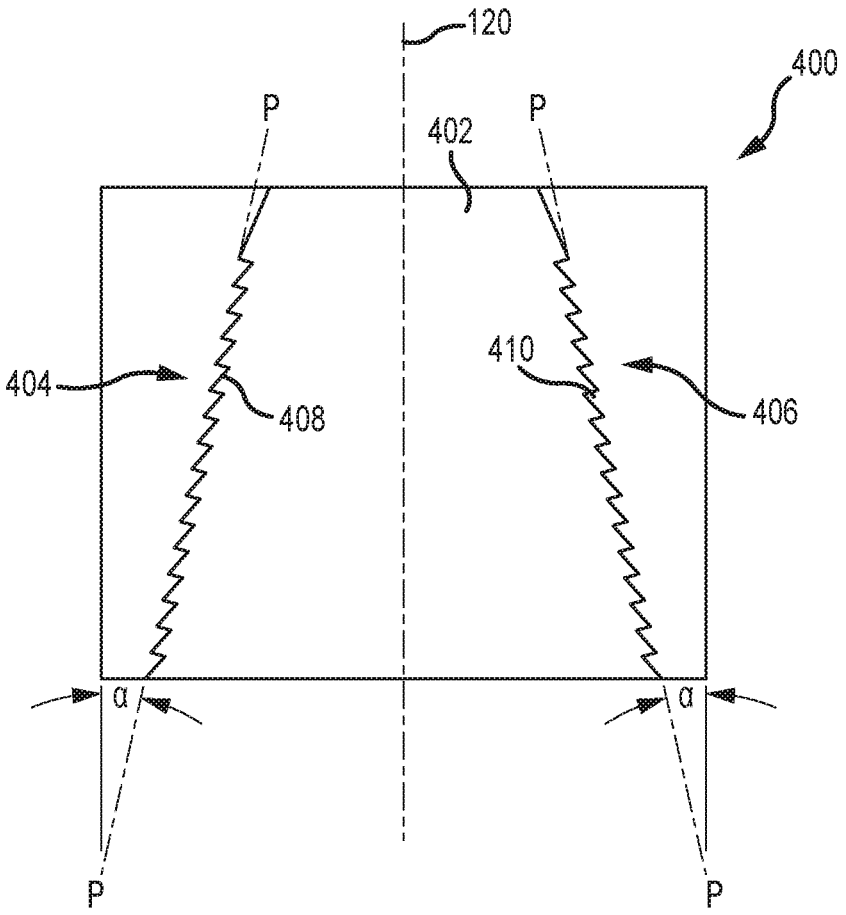
FIG. 5 is an enlarged view of an example of a mounting bracket.

FIG. 5 is an enlarged view of an example of a mounting bracket 400 for use with the window balance systems described herein. The mounting bracket 400 includes a body 402 having a pair of racks, for example, a first rack 404 and a second rack 406 formed therein. Each rack 404 and 406 has a plurality of teeth 408 and 410, respectively, extending therefrom. The body 402 extends along the longitudinal axis 120, while the racks 404 and 406 extend at an angle $\alpha$ relative to the longitudinal axis 120 and along a pitch axis P. For example, each rack 404 and 406 is pitched at an angle $\alpha$ within a range between and including 0° to about 15° in relation to the longitudinal axis 120. In other examples, the angle $\alpha$ may be between about 3° and about 12°. In another example, the angle $\alpha$ may be between about 5° and about 10°. Other angles $\alpha$ are contemplated that enable the mounting bracket 400 to function as described herein.

In operation, by pitching the racks 404 and 406, a retention force between the resilient arms (not shown) and an associated tooth of the rack 404 and 406 increases as each tooth extends farther up the rack 404 and 406 (e.g., towards a top of the mounting bracket 400), and forming a variable force ratchet system within the window balance system. In alternative examples, each rack 404 and 406 may be formed on the shoe body (not shown) as depicted in FIG. 3.

Figure 6:
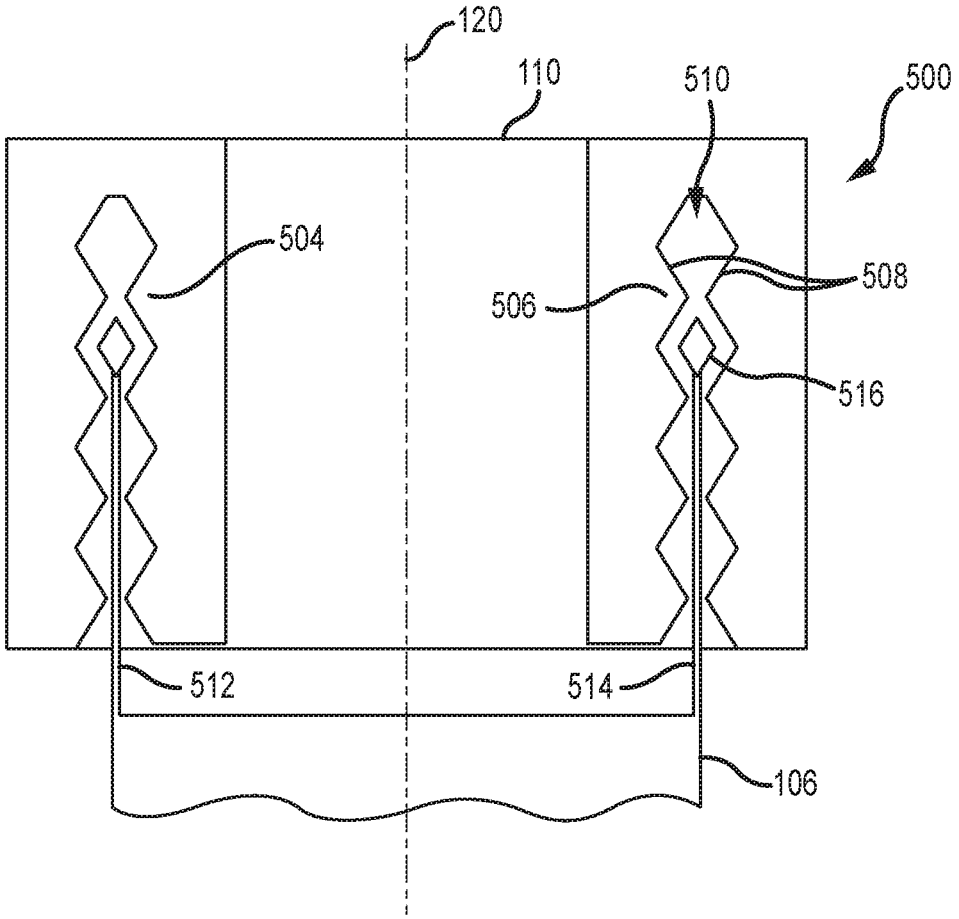
FIG. 6 is an enlarged view of another mounting bracket.

FIG. 6 is an enlarged view of another mounting bracket that may be used with the window balance systems described herein. A ratchet system 500 includes the mounting bracket 110 having a pair of racks, for example, a first rack 504 and a second rack 506 formed therein. Each rack 504 and 506 has a pair of facing toothed structures 508 extending therein such that a channel 510 is defined therebetween. The shoe body 106 includes a pair of resilient arms 512 and 514 that include a corresponding pawl 516 extending therefrom that are receivable with the channel 510. In operation, the shoe body 106 couples to the mounting bracket 110 via the racks 504 and 506 inducing a retaining force on the resilient arms 512 and 514 and pawls 516 thereon. In alternative examples, each rack 504 and 506 may be formed on the shoe body 106 and the resilient arms 512 and 514 extending from the mounting bracket 110 as depicted in FIG. 3.

Figure 7:
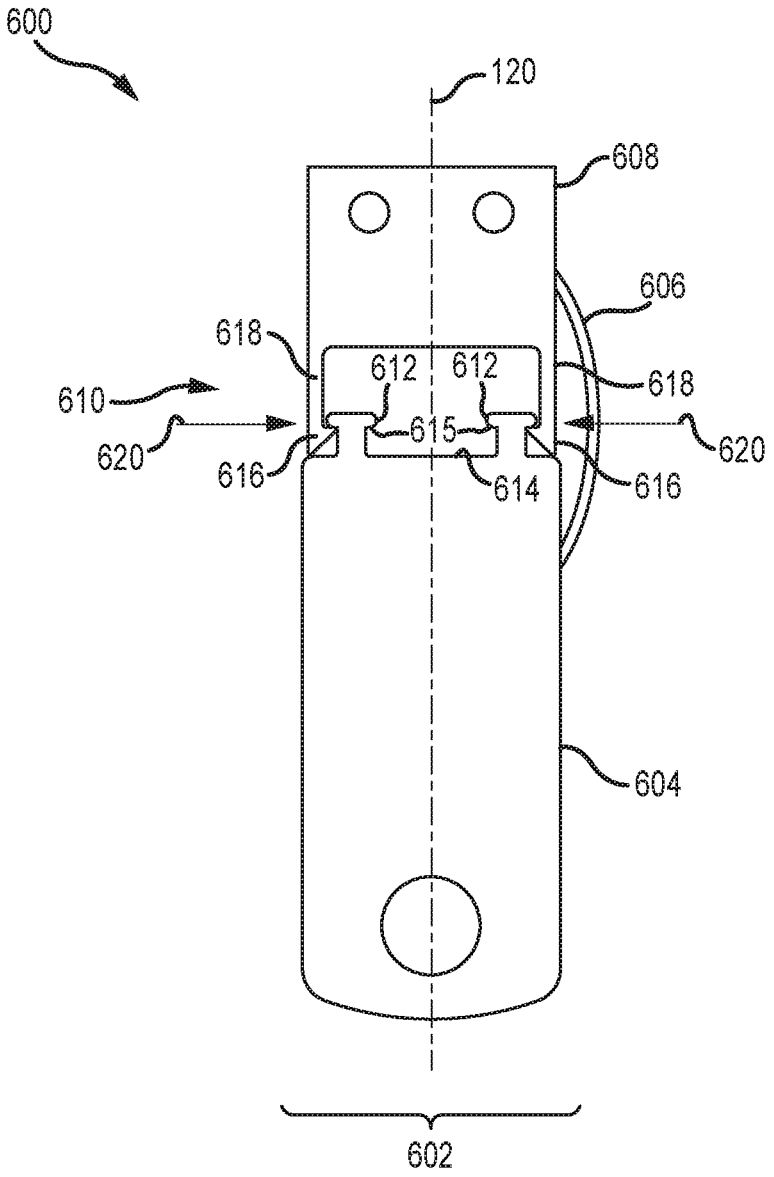
FIG. 7 is a front view of another inverted constant force window balance system in an engaged position.

FIG. 7 is a front view of another inverted constant force window balance system 600 in an engaged position 602. Similar to the window balance systems described above, the window balance system 600 includes a shoe body 604 (also known as a carrier), a coil spring 606, and a mounting bracket 608. In this example, the shoe body 604 is substantially rectangularly shaped and houses the coil spring 606 therein. The shoe body 604 is described further in U.S. Pat. No. 5,353,548, the disclosure of which is hereby incorporated by reference herein in its entirety. The window balance system 600 also includes a ratchet system 610 that enables the shoe body 604 to releasably couple to the mounting bracket 610. The ratchet system 610 includes at least one static receiving member, for example, a pair of static receiving members 612, extending from an end surface 614 of the shoe body 604. In this example, the static receiving members 612 are dog bone shaped members that extend along the depth of the shoe body 604. Each static receiving member 612 includes an inner surface 615 that is opposite the end surface 614. The ratchet system 610 further includes at least one pawl, for example, a pair of pawls 616 each extending from a resilient arm 618 coupled to and extending from the mounting bracket 608. In this example, each pawl 616 extends from the resilient arm 618 in a different direction, for example, towards and away from the longitudinal axis 120.

In operation, the pawls 616 selectively engage and disengage with the static receiving members 612 via a resilient retaining force 620. More specifically, when the mounting bracket 608 is received by the shoe body 604, each pawl 616 deflects the resilient arm 618 from an original position around the static receiving members 612 such that each pawl 616 engages with its associated inner surface 615. The resilient arms 618 may deflect or flex from the original position without being permanently deformed. In the engaged position 602, deflection of the resilient arms 618 induce the retaining force 620 that is normal to the longitudinal axis 120 such that the pawls 616 are engaged with the static receiving members 612. When in the engaged position 602, the ratchet system 610 enables the mounting bracket 608 to be coupled to the shoe body 604. This coupling prevents undesirable separation between the mounting bracket 608 and the shoe body 604 during shipping and window assembly of the window balance system 600. Furthermore, when the window sash is raised to the fully-opened position, the ratchet system 610 may further support the weight of the window sash to reduce window sash drop. The ratchet system 610 further enables the pawls 616 to disengage with the static receiving members 612 upon a disengagement force being induced along the longitudinal axis 120. The disengagement force is sufficient to overcome the retaining force 620 that engages the pawls 616 with the static support members 612 so as to defect the resilient arms 618.

Figure 8:
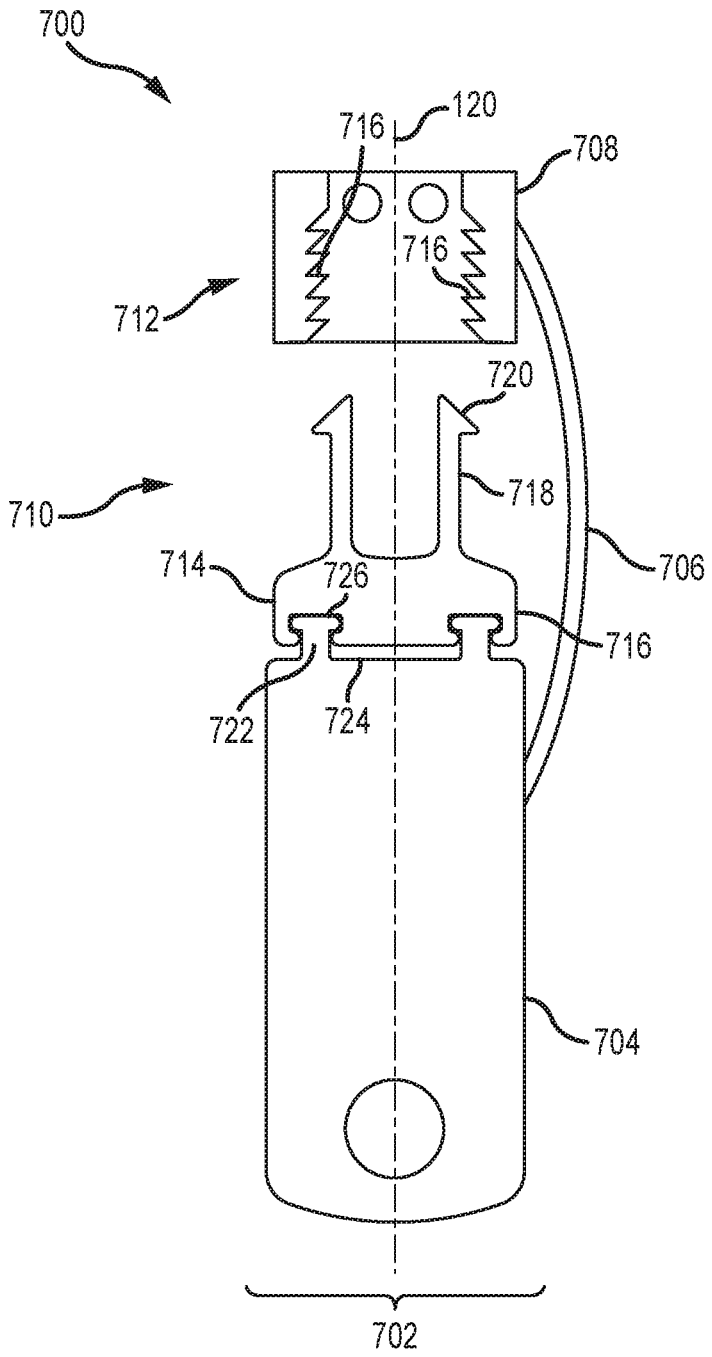
FIG. 8 is a front view of another inverted constant force window balance system in a disengaged position.

FIG. 8 is a front view of another inverted constant force window balance system 700 in a disengaged position 702. Similar to the window balance systems described above, the window balance system 700 includes a shoe body 704, a coil spring 706, and a mounting bracket 708. In this example, the shoe body 704 is substantially rectangularly shaped and houses the coil spring 706 therein, as described in more detail in FIG. 7 above. However, in this example, a ratchet system 710 includes a receiving member 712 defined in the mounting bracket 708 and an engagement member 714 coupled to the shoe body 704. The receiving member 714 includes a pair of racks 716 defined on facing surfaces of the mounting bracket 708, similar to the examples described above in reference to FIGS. 2A, 2B, and 4A-6. The engagement member 714 includes a body 716 that is coupled to the shoe body 704. The engagement member body 716 includes a pair of resilient arms 718 that extend along the longitudinal axis 120. At each free end of the resilient arms 718, a pawl 720 extends therefrom that is engageable with the racks 716. The engagement member body 716 is removably coupled to the shoe body 706 via static receiving members 722. Similar to FIG. 7 described above, static receiving members 722 are dog bone shaped members that extend from an end surface 724 of the shoe body 704. The engagement member body 716 includes a pair of corresponding recesses 726 that receive the static receiving members 722. In alternative examples, the racks 716 may be defined within engagement member body 716 and the resilient arms 718 extend from the mounting bracket 708 similar to the example described above in reference to FIG. 3.

In operation, the engagement member body 716 is removably coupled to the shoe body 704 such that the ratchet system 710 is formed on the window balance system 700 and the shoe body 704 may be releasably coupled to the mounting bracket 710, as described in detail above. As such, when in an engaged position, the ratchet system 710 enables the mounting bracket 708 to be coupled to the shoe body 704 via the engagement member body 716 to prevent undesirable separation between the mounting bracket 708 and the shoe body 704 during shipping and window assembly of the window balance system 700. Furthermore, when the window sash is raised to the fully-opened position, the ratchet system 710 may further support the weight of the window sash to reduce window sash drop in a fully-open position.

The materials utilized in the engagement systems described herein may be those typically utilized for window and window component manufacture. Material selection for most of the components may be based on the proposed use of the window. Appropriate materials may be selected for the sash retention systems used on particularly heavy window panels, as well as on windows subject to certain environmental conditions (e.g., moisture, corrosive atmospheres, etc.). Aluminum, steel, stainless steel, or composite materials can be utilized. Bendable and/or moldable plastics may be particularly useful. For example, the shoe body and/or the mounting bracket may be unitarily formed with the engagement member and/or the receiving member. While in other examples, the engagement member and/or receiving member may couple to the shoe body and/or mounting bracket as an accessory for the window balance system.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A window balance system comprising:

a mounting bracket configured to be secured to a window jamb;

a shoe body defining a longitudinal axis;

a coil spring movably coupling the mounting bracket to the shoe body;

an engagement member extending from at least one of the mounting bracket and the shoe body, wherein the engagement member comprises at least one resilient arm having a pawl extending therefrom; and a receiving member defined in at least the other one of the mounting bracket and the shoe body, wherein the receiving member comprises at least one rack having at least one tooth extending therefrom such that the pawl is engageable with the at least one tooth, and wherein the engagement between the pawl and the at least one tooth at least partially deflects the resilient arm in a direction toward and away from the longitudinal axis.

2. The system of claim 1, wherein the at least one resilient arm extends longitudinally from an end portion of the shoe body and the pawl comprises an enlarged end of the at least one resilient arm.

3. The system of claim 1, wherein the at least one rack is disposed at an angle in relation to the longitudinal axis.

4. The system of claim 3, wherein the angle is within a range between and including 0° and 15°.

5. The system of claim 1, wherein the engagement member comprises a first resilient arm and a second resilient arm, wherein each pawl faces in an opposite direction.

6. The system of claim 5, wherein the receiving member comprises a first rack and a second rack, wherein each at least one tooth faces in an opposite direction.

7. The system of claim 5, wherein the shoe body comprises a carrier configured to receive a curled portion of the coil spring.

8. The system of claim 1, wherein the engagement member extends from the mounting bracket and the receiving member is defined in the shoe body.

9. The system of claim 1, wherein the at least one rack comprises a pair of facing toothed structures defining a channel therebetween, the channel configured to receive the pawl therein.

10. The system of claim 1, wherein the engagement member comprises a body coupled to the shoe body.

11. A window balance system comprising:

a shoe body comprising:

an end portion; and a pair of resilient arms extending from the end portion, each resilient arm having a pawl extending therefrom; and a mounting bracket comprising a pair of racks, each rack having a plurality of teeth extending therefrom such that each pawl is engageable with the corresponding rack.

12. The system of claim 11 further comprising a coil spring configured to couple the shoe body to the mounting bracket.

13. The system of claim 11, wherein the pair of racks are disposed on facing surfaces of the mounting bracket.

14. The system of claim 11, wherein the pawl comprises an angled tooth extending away from an elongate axis of the resilient arm.

15. The system of claim 14, wherein the angled tooth comprises a leading angular face and a trailing angular face, the trailing angular face is configured to engage with the plurality of teeth.

16. The system of claim 11, wherein the pawl is configured to engage with any one of the plurality of teeth.

* * * * *